US007517414B1

(12) United States Patent
Reed

(10) Patent No.: US 7,517,414 B1
(45) **Date of Patent: *Apr. 14, 2009**

(54) METHOD OF CLEANING AND DEGREASING SURFACES

(76) Inventor: William C. Reed, 5753 Whistlewood Cir., Sarasota, FL (US) 34232

( * ) Notice: Subject to any disclaimer, the term of this patent is extended or adjusted under 35 U.S.C. 154(b) by 494 days.

This patent is subject to a terminal disclaimer.

(21) Appl. No.: 11/437,779

(22) Filed: May 19, 2006

Related U.S. Application Data

(63) Continuation-in-part of application No. 10/919,725, filed on Aug. 17, 2004, now Pat. No. 7,052,555, which is a continuation of application No. 09/802,308, filed on Mar. 8, 2001, now Pat. No. 6,776,920.

(51) Int. Cl.
*B08B 3/00* (2006.01)
*B08B 7/00* (2006.01)
*C23D 17/00* (2006.01)

(52) U.S. Cl. ..... 134/34; 134/32; 134/33; 134/38; 134/39; 134/40; 134/25.1; 134/10; 134/4

(58) Field of Classification Search ..... 134/34
See application file for complete search history.

(56) References Cited

U.S. PATENT DOCUMENTS

| | | | | | |
|---|---|---|---|---|---|
| 2,428,798 | A | * | 10/1947 | Glassbrook et al. | 208/120.01 |
| 4,368,134 | A | * | 1/1983 | Kaeser | 510/532 |
| 5,415,900 | A | * | 5/1995 | Reed | 427/547 |
| 5,537,363 | A | * | 7/1996 | Holcomb | 366/273 |
| 5,573,817 | A | * | 11/1996 | Reed | 427/561 |
| 5,599,531 | A | * | 2/1997 | Holcomb | 424/70.1 |
| 5,658,573 | A | * | 8/1997 | Holcomb | 424/400 |
| 5,804,068 | A | * | 9/1998 | Reed | 210/222 |
| 6,607,648 | B1 | * | 8/2003 | Franceschetti et al. | 204/557 |
| 6,776,920 | B1 | * | 8/2004 | Reed | 252/8.05 |
| 7,052,555 | B1 | * | 5/2006 | Reed | 134/34 |

* cited by examiner

*Primary Examiner*—Joseph D. Anthony
(74) *Attorney, Agent, or Firm*—William Nitkin

(57) ABSTRACT

The application of a gel-like material is disclosed for cleaning a surface having foreign matter thereon, such gel-like material produced by magnetically treating and mixing two solutions, the first solution being comprised of water and sodium bicarbonate and the second solution comprised of water and sodium silicate. The first solution is passed through a positively charged magnetic field, and the second solution is passed through a negatively charged magnetic field. The two solutions are then mixed together to form a gel.

5 Claims, No Drawings

METHOD OF CLEANING AND DEGREASING SURFACES

This application is a continuation-in-part of my previous application entitled Method of Removing Surface Coatings, Ser. No. 10/919,725 filed Aug. 17, 2004, now U.S. Pat. No. 7,025,555, which was a continuation of my previous application entitled Heat-absorbing Gel Material Ser. No. 09/802,308 filed Mar. 8, 2001, now U.S. Pat. No. 6,776,920.

BACKGROUND OF THE INVENTION

1. Field of the Invention

The present invention resides in the field of cleaning agents and more particularly relates to the application of a magnetically treated water-based solution of sodium silicate and sodium bicarbonate formed in a gel used as a degreasing and dirt removal agent.

2. Description of the Prior Art

U.S. Pat. No. 5,415,900 to Reed discloses a method of delivering a substance into a material mass. This invention is specifically directed to the rearrangement of fluid molecules from an agglomerated state to a more linear and organized state. As a result of this linear molecular organization produced by a magnetic influence, the fluid's permeability into a material mass is greatly enhanced, and penetration of the fluid through the surface and periphery of the material mass occurs much more readily than if the fluid's molecular organization had remained in an agglomerated state. The magnetic influence utilized in this invention not only makes the fluid more permeable by effecting a linear organization of its molecules, which is a critical feature of the invention, but also serves to facilitate the assimilation of such fluids throughout the interior of the material mass. This is accomplished by polarizing two fluids to opposite charges with magnetic fields of different polarities. As a result, the naturally attractive forces between the oppositely charged fluids increases the rate of absorption of the second fluid to be introduced into the material mass and ensures that the absorption of this second fluid is directed throughout the interior of the material mass.

An additional advantage of the fluid polarization effected by a magnetic influence is that the positive polarity of the fluid molecules will be increased, thereby increasing the spaces between the individual fluid molecules through greater repellence. As a result of this increased polarity, the fluid molecules are separated to a greater extent so that the molecules are able to penetrate individually rather than collectively into a given material mass, thereby significantly enhancing the permeability of the fluid. In addition, because fluid molecules which are positively charged by a magnetic influence become more separated, chemically reactive agents that are added to the fluids, which serve as carrier vehicles, attain a more uniform distribution amongst the fluid molecules. After the carrier fluids and chemically reactive agents therein are introduced into the material mass, the more uniform dispersion of the chemical agents in the carrier fluids results in an acceleration of the normal reaction time of such chemically reactive agents within the interior of the material mass.

U.S. Pat. No. 5,804,068 to Reed discloses a magnetic fluid treatment device. The object of this invention is to provide a device that can effectively polarize a fluid contained therein in order to gradually rearrange its fluid molecules into a more linear, organized and substantially more permeable state.

SUMMARY OF THE INVENTION

The present invention is directed to the application of a gel produced by combining polarized fluids used to remove grease, dirt and stains. The present invention discloses how the mixture of varying ratios of water to sodium silicate and water to sodium bicarbonate can create a gel having excellent properties in removing grease and oil in a nontoxic manner.

The present invention is directed towards a magnetically treated sodium silicate and sodium bicarbonate gel used as a degreaser and cleaning agent which exhibits the following properties:

a. The ability to emulsify and assimilate to petroleum-based materials;

b. The ability to remove and clean cooking oils or grease-laden surfaces;

c. The ability to be completely dissolved in the presence of water;

d. The ability to eliminate outer stain rings when applied to previous oil stains in surfaces such as concrete and stone;

e. The ability to lift stains when left overnight on materials such as marble and granite;

f. The ability to be applied on concrete where oils have previously stained the surface, scrubbed the oil stain, allowed to dry overnight and removed the following day by application of water, rendering a clean and oil-free surface;

g. The ability to remove and absorb the odors that may be inherently a part of the material to be removed;

h. The material formulation is completely biodegradable and environmentally friendly;

i. The ability to add materials, such as pumice, to create frictional qualities used in hand cleaners;

j. When used with imbibitional beads, the material formulation can be used to clean up oil deposits in environmentally sensitive areas;

k. The ability to be flushed down conventional sewer and waste systems without damage or harm to the environment;

l. The material formulation is non-corrosive to metals; and m. The material formulation can be used on virtually any type of surface.

To produce such gel, for example, a first solution is created by mixing 55 gallons of water with 50 lb. of sodium bicarbonate and passing the resulting mixture through a magnetic device of positive polarity, such as the device taught in U.S. Pat. No. 5,804,068, to create a positively charged solution. A second solution is made by mixing 44 gallons of water with 11 gallons of sodium silicate and passing the resulting mixture through a magnetic device of negative polarity, such as the device taught in U.S. Pat. No. 5,804,068, to create a negatively charged solution. In order to produce a gel material, the positively charged first solution is placed in a container with the negatively charged second solution in equal amounts and mixed together and allowed to set. The initial set time of the combined solution is predicated on the catalyst concentrations, the liquid material temperature and the delivery process. The material is allowed to set and then re-mixed to achieve a smooth, gel-like quality. While these two mixtures will ultimately form a gel when mixed together in an uncharged state, by magnetically activating the two solutions, the resulting gel has the above listed cleaning properties and is more highly structured to provide for a more uniform assimilation of oil and/or dirt. When distilled quality water with no particulate matter is used, shelf life of the gel is completely stable. Once the two-component material is mixed, it can be containerized and will remain stable for a long period of time. The gel also has the ability to maintain its structure and formation under extreme heat.

In other embodiments of this invention, varying ratios of water to sodium silicate and of water to sodium bicarbonate can be used to develop the desired gel density, resulting in a desired gel density suitable for removing grease, dirt, stains and oil from all types of surfaces. By removing water from the gel, the resulting hydrate can be re-wet to act as a cleaning agent. Salt water can be used in place of plain water with the formulation to achieve similar cleaning characteristics. The addition of a soap or surfactant to the formulation can be used to convert the gel to a foam-type gel material. The addition of an aggregate, such as pumice, to the gel can impart further cleaning and dirt and oil removal capacity.

The Occupational Health and Safety Agency (OSHA) and the Environmental Protection Agency (EPA) monitor the application, use, containment and disposal of many solvents and other chemicals used as surface cleaning agents. Many surface cleaning agents and existing cleaning systems have detrimental side effects in their application, both to the user and to the environment. Many types of degreasers and oil-reducing materials are based on the use of chemicals and agents that are toxic in nature and potentially harmful if not used appropriately. Thus it is an object of the present invention to provide a nontoxic, environmentally friendly material for use as a surface cleaner. The mixture of the primary chemicals of sodium bicarbonate and sodium silicate mixed to a highly diluted state with water is considered nontoxic and unregulated by the Department of Transportation (DOT). Each of the primary chemical components is nontoxic and nonhazardous as stated in its respective Material Safety Data Sheet. The gel of this invention starts with a two-component clear liquid that is composed primarily of water. The active ingredients are not regulated by either the DOT or OSHA. When the materials are combined, a reaction occurs that forms a gel-like material with no heat produced. Once the gel is formed, it can later be completely dissolved by introducing water to the gel, causing the gel to return to its liquid state. To dissolve and remove the gel material of this invention, water can be either sprayed or added to the material, causing the gel material to liquefy and return to a liquid state. If left exposed to the air with no moisture present, the material will form dendritic crystals and eventually will fully disintegrate.

DESCRIPTION OF THE PREFERRED EMBODIMENT(S)

In one example, as discussed above, the first solution can be created by mixing 55 gallons of water with 50 lb. of sodium bicarbonate and passing such mixture through a magnetic device of positive polarity (See U.S. Pat. No. 5,804,068 to Reed). A second solution can be made by mixing 11 gallons of sodium silicate with 44 gallons of water and passing the mixture through a negatively charged magnetic field. The two solutions are then mixed together in equal amounts. The resulting mixture sets over time to form a gel. By magnetically activating the two solutions of the mixture, the mixture acquires the aforementioned cleaning and degreasing properties. The gel material encapsulates, emulsifies and dissolves dirt and grease by simple application to the surface. Once the gel material is applied, the surface can be agitated by scrubbing the gel into the soiled area. Once clean, the surface is then rinsed and wiped dry. The cohesive quality of the gel imparts the containment of the materials being removed. As the grease, dirt and oil products are emulsified and absorbed by the gel material, any odors from the material being removed are absorbed, if not eliminated. Since the gel is nontoxic, odorless, colorless and phosphate-free, the material suspended in the gel can be easily collected, making disposal safe and economical.

To dissolve the gel, when desired, water can be either sprayed onto, or added to, the mixture. The gel then liquefies immediately and is nontoxic and can be removed as an non-toxic liquid would be removed.

Although the present invention has been described with reference to particular embodiments, it will be apparent to those skilled in the art that variations and modifications can be substituted therefor without departing from the principles and spirit of the invention.

I claim:

1. A method for cleaning a surface, said surface having foreign matter thereon, such as grease, dirt particles, oil and stains, comprising the steps of:

providing a first solution made by mixing water with sodium bicarbonate;

providing a second solution made by mixing water with sodium silicate;

passing said first solution through a positively charged magnetic field;

passing said second solution through a negatively charged magnetic field;

mixing equal parts of said first solution and said second solution together to form a mixture;

allowing said mixture to stand and set, thereby forming a gel;

introducing said gel onto said surface to be cleaned of said foreign matter;

surrounding said foreign matter with said gel; and removing said gel and surrounded foreign matter from said surface, leaving a clean surface.

2. The method of claim 1 wherein said step of removing said gel and foreign matter from said surface includes the steps of:

collecting said foreign matter surrounded by said gel; and rinsing said foreign matter surrounded by said gel with water to liquefy said gel and cause it to run off; and recovering said foreign matter for proper disposal.

3. The method of claim 1 further including after the step of mixing said first and second portions, the step of:

adding a surfactant to said mixture to convert said gel to a foam-type gel material.

4. The method of claim 1 further including after the step of mixing said first and second portions, the step of:

adding an aggregate to said mixture.

5. The method of claim 1 further including the steps of:

removing water from said gel to form a hydrate; and adding water to said hydrate to form a cleaning agent.

* * * * *